US008807041B2

(12) United States Patent
Geismar

(10) Patent No.: US 8,807,041 B2
(45) Date of Patent: Aug. 19, 2014

(54) METHOD AND SYSTEM FOR EXTENDING A RAILWAY TRACK

(75) Inventor: Daniel Geismar, Neuilly sur Seine (FR)

(73) Assignee: Societe des Anciens Etablissements L. Geismar, Neuilly sur Seine (FR)

( * ) Notice: Subject to any disclaimer, the term of this patent is extended or adjusted under 35 U.S.C. 154(b) by 107 days.

(21) Appl. No.: 13/510,141

(22) PCT Filed: Nov. 9, 2010

(86) PCT No.: PCT/FR2010/052404

§ 371 (c)(1),
(2), (4) Date: Jul. 23, 2012

(87) PCT Pub. No.: WO2011/058271

PCT Pub. Date: May 19, 2011

(65) Prior Publication Data

US 2012/0279414 A1 Nov. 8, 2012

(30) Foreign Application Priority Data

Nov. 16, 2009 (FR) ..... 09 58066

(51) Int. Cl.
*E01B 29/02* (2006.01)

(52) U.S. Cl.
CPC ..... *E01B 29/02* (2013.01)
USPC ..... 104/3

(58) Field of Classification Search
USPC ..... 104/2–5
See application file for complete search history.

(56) References Cited

U.S. PATENT DOCUMENTS

| | | | | | |
|---|---|---|---|---|---|
| 2,696,791 | A | * | 12/1954 | Boulard | 104/3 |
| 4,608,928 | A | * | 9/1986 | Theurer et al. | 104/3 |
| 4,773,332 | A | * | 9/1988 | Theurer et al. | 104/3 |
| 4,784,063 | A | * | 11/1988 | Theurer et al. | 104/3 |
| 4,827,848 | A | * | 5/1989 | Kusel | 104/3 |

FOREIGN PATENT DOCUMENTS

| | | | | | |
|---|---|---|---|---|---|
| CH | 657649 | A5 | * | 9/1986 | E01B 27/11 |
| EP | 505240 | A1 | * | 9/1992 | E01B 29/02 |
| FR | 2546924 | A1 | * | 12/1984 | E01B 29/02 |
| GB | 2 432 564 | A | | 5/2007 | |
| WO | WO 2007/053020 | A1 | | 5/2007 | |
| WO | WO 2009/050439 | A1 | | 4/2009 | |

OTHER PUBLICATIONS

European Patent Office, International Search Report in International Patent Application No. PCT/FR2010/052404 (Mar. 3, 2011).

* cited by examiner

*Primary Examiner* — Zachary Kuhfuss
(74) *Attorney, Agent, or Firm* — Leydig, Voit & Mayer, Ltd.

(57) ABSTRACT

A method for extending a railway track downstream from an existing track end includes transporting a common track panel; positioning the common track panel downstream from the existing track, deploying an off-track moving mechanism and positioning an upstream end of the common panel vertically, in line with the existing track end; releasing the common track panel, removing the off-track moving mechanism; and installing the common track panel, by lowering the common track panel until the upstream end of the common track panel is aligned with the existing track end.

12 Claims, 14 Drawing Sheets

METHOD AND SYSTEM FOR EXTENDING A RAILWAY TRACK

FIELD OF THE INVENTION

The present invention concerns a method and system for extending railway track downstream of one end of existing track.

BACKGROUND

To place in position the cross-ties and rails required for building railway lines, known methods and systems are generally heavy and cumbersome.

Various means have already been proposed for streamlining railway track laying systems.

Document GB 2432564 describes a machine arranged to lay track panels alongside a wagon transporting track panels, by means of a pivoting arm. The machine described is suitable for creating new track alongside pre-existing track. It appears to be difficult, even impossible, to use the described machine for creating new track if there is no pre-existing track parallel to the new track.

Document WO2009/050439 uses means of small size in particular one or more vehicles capable of moving outside the track which do not require the existence of pre-existing adjacent track. However the described means, which only allow rails to be moved, clearly cannot be used if cross-ties are not previously laid.

SUMMARY OF THE INVENTION

The present invention sets out to overcome the drawbacks of the known prior art.

For this purpose, so as to extend a railway track downstream of one end of existing track, the subject of the invention is a method comprising:

a step to convey a current track panel whereby an operator causes a motorized lorry to travel on the existing track, the lorry comprising rail wheels and a retracted mechanism for off-track travel and carrying the said current panel, so as to bring the motorized lorry close to the said track end;

a step for positioning the current panel downstream of the existing track, whereby the operator deploys the off-track travel mechanism so as to position an upstream end of the current panel directly above the end of the existing track by causing the motorized lorry to travel downstream of the existing track;

a step to release the current panel whereby the operator evacuates the motorized lorry leaving the upstream end of the current panel directly above the end of the existing track; and a step to lay the current panel whereby the operator lowers the current panel until the upstream end of the current panel coincides with the end of the existing track.

Advantageously, to deploy the off-track travel mechanism:

the conveying step comprises a first transient phase in which the operator brings the motorized lorry near, causing it to carry connecting track bracket-suspended at the front, until a rear end of the connecting track is placed directly above the end of the existing track;

the positioning step comprises a second transient phase in which the operator lowers the connecting track in the continuation of the existing track, a third transient phase in which the operator causes the motorized lorry to move forward along the connecting track until it is possible to deploy the off-track travel mechanism off the existing track, and a fourth transient phase in which the operator deploys the off-track travel mechanism.

In particular to evacuate the motorized lorry, the release step comprises a fifth transient phase in which the operator uses the off-track travel mechanism to return the motorized lorry over the connecting track, a sixth transient phase in which the operator retracts the off-track travel mechanism to re-position the rail wheels of the motorized lorry in contact with the connecting track, a seventh transient phase in which the operator drives the motorized lorry back from the connecting track onto the existing track so as to take hold of the connecting track, an eighth transient phase in which the operator causes the connecting track to be lifted, and a ninth transient phase in which the operator reverses the motorized lorry bringing the connecting track to above the existing track.

Advantageously also, to leave the upstream end of the current panel directly above the existing track end:

the conveying step comprises a first laying phase in which the operator hooks at least one first extendable gantry crane onto the current panel.

the positioning step comprises a second laying step whereby the operator immobilizes the motorized lorry when the entirety of the current panel is downstream of the existing track, and a third laying phase whereby the operator lowers one or more legs of the said at least first extendable gantry crane until they rest on the ground so as to lift the said gantry which then lifts the current panel to above the motorized lorry.

In particular, the laying step comprises a fourth laying phase in which the operator lowers the said at least one first extendable gantry crane so as to lay the current panel in the continuation of the existing track then unhooks the said first extendable gantry crane from the current panel, and a fifth laying phase in which the operator lifts the said first extendable gantry crane.

Further advantageously the method comprises a transfer step in which the operator loads a following panel on the motorized lorry so as to re-loop the implementation of the method onto the conveying step at which the following panel becomes the current panel.

More particularly, the transfer step comprises a first transfer phase in which the operator brings a beam carried by the motorized lorry to under at least one second extendable gantry crane from which the said following panel is suspended, and a second transfer phase in which the operator lowers the said second extendable gantry crane so as to lay the said following panel on the said beam.

More particularly the transfer step comprises a third transfer phase in which the operator lifts the said a least one second extendable gantry crane so as to leave the said following panel on the said beam, and a fourth transfer phase in which the operator moves forward the motorized lorry so as to place the beam underneath the said at least one first extendable gantry crane.

Preferably at least one of the transfer phases is conducted during the laying step.

To extend railway track downstream of one end of existing track, a further subject of the invention is a system comprising:

a motorized lorry which comprises rail wheels to travel on the existing track, and a retractable off-track travel mechanism so as to be able to transport a current track panel on the existing track and off the existing track;

at least one first extendable gantry crane arranged to hook the current panel thereupon; and connecting track removably bracket-suspended at the front of the motorized lorry.

In particular, the system comprises a beam arranged to support the current panel on the said motorized lorry.

Advantageously the system comprises at least one second extendable gantry crane arranged to hook the following panel thereupon.

Also advantageously, the system comprises a rail lorry to support the beam by accompanying the movements of the motorized lorry, without leaving the track.

Also advantageously, the connecting track comprises two rails of length substantially equal to the length of the motorized lorry, held together by cross-ties of length equal to the spacing between the rails.

BRIEF DESCRIPTION OF DRAWING FIGURES

The invention will be better understood and other objectives, characteristics, details and advantages thereof will become more clearly apparent in the explanatory description below with reference to the appended schematic drawings given solely as examples illustrating one embodiment of the invention and in which.

Figure 25B:
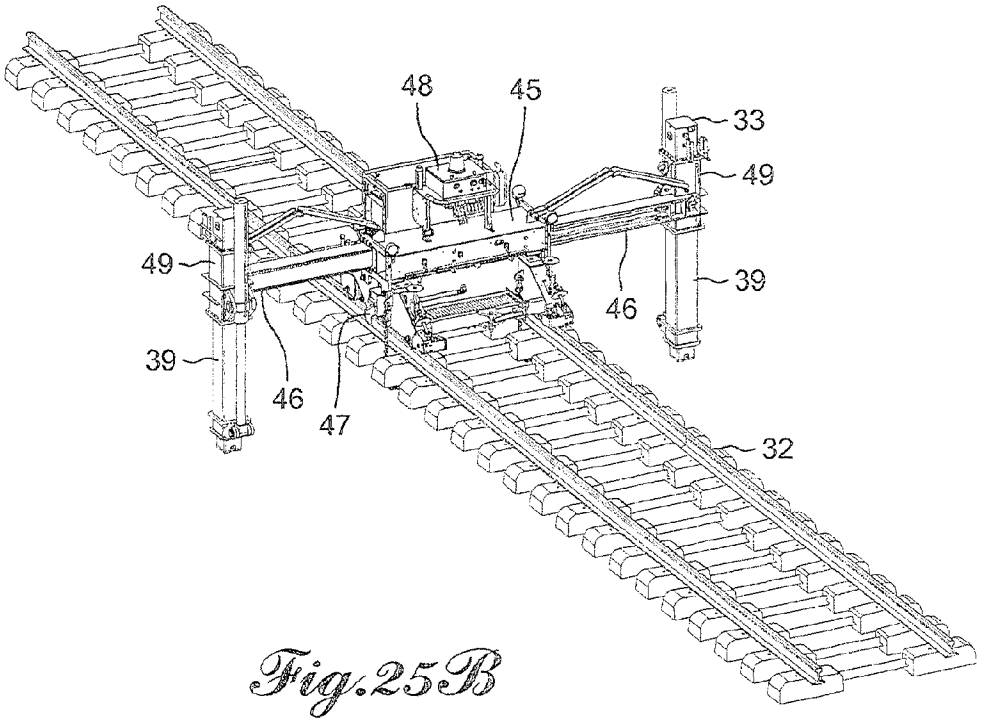
Figure 25A:
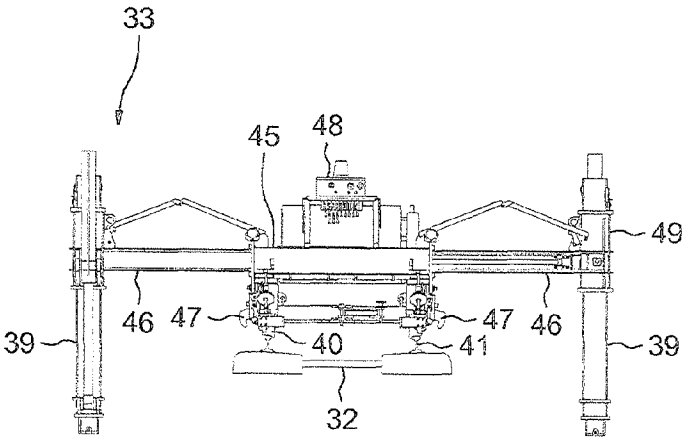
Figure 26B:
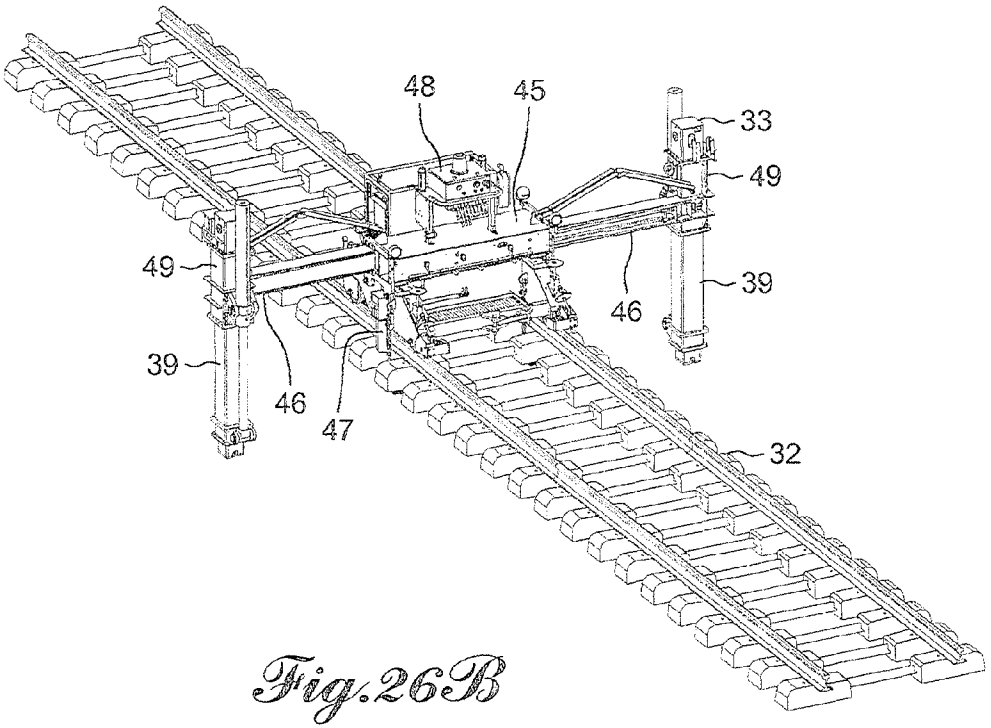
Figure 26A:
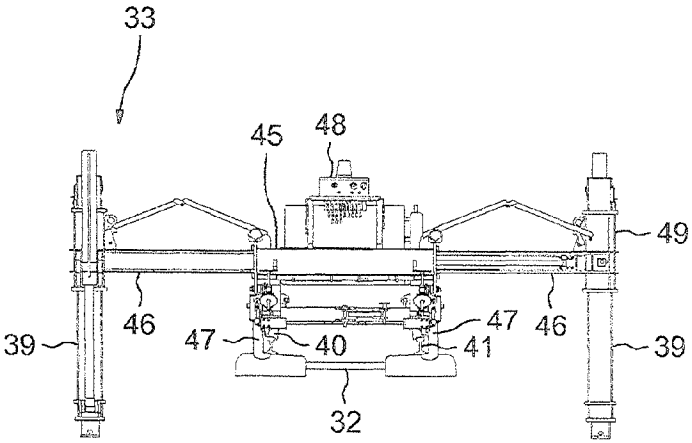
Figure 27:
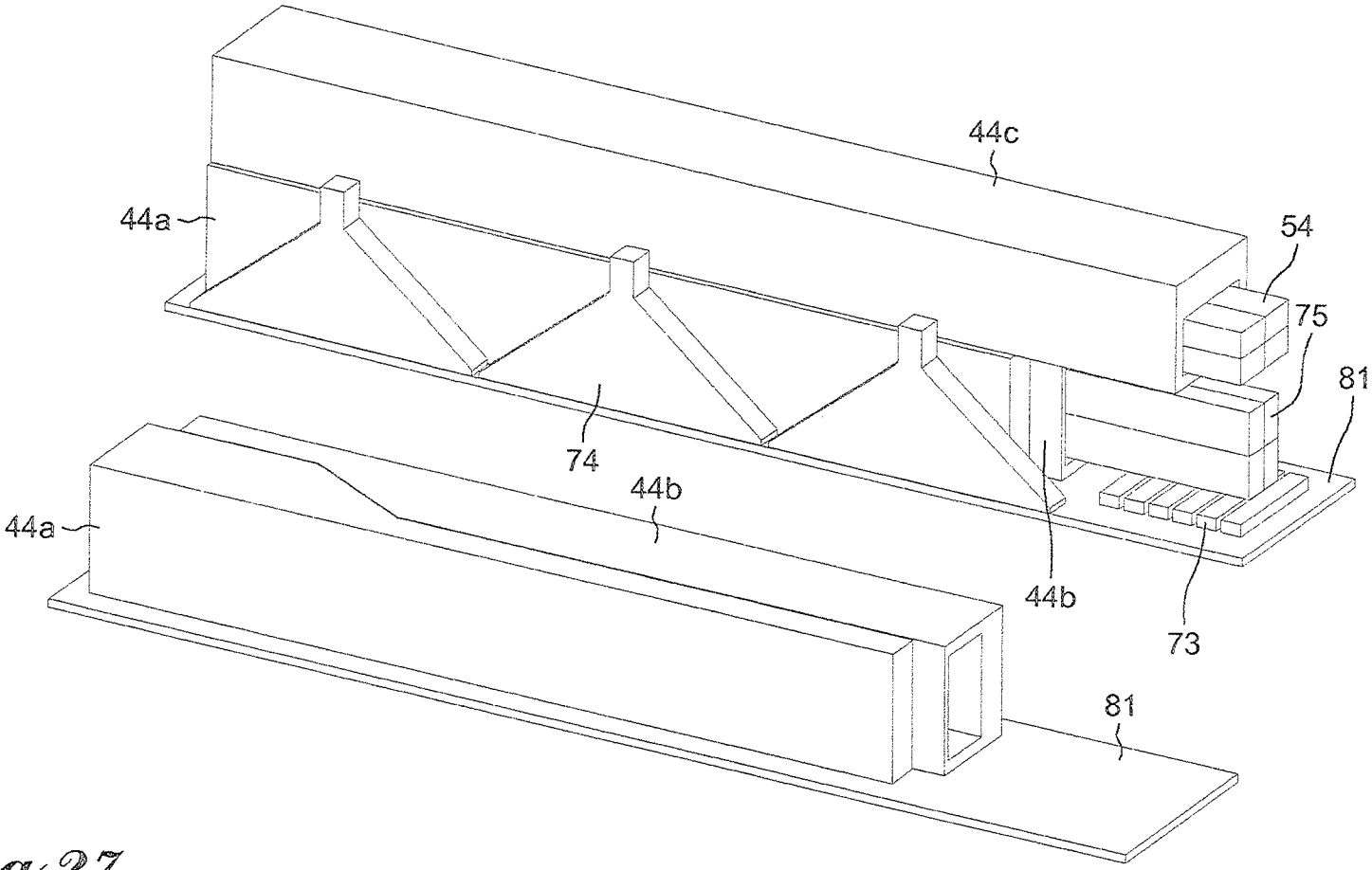
Figure 28:
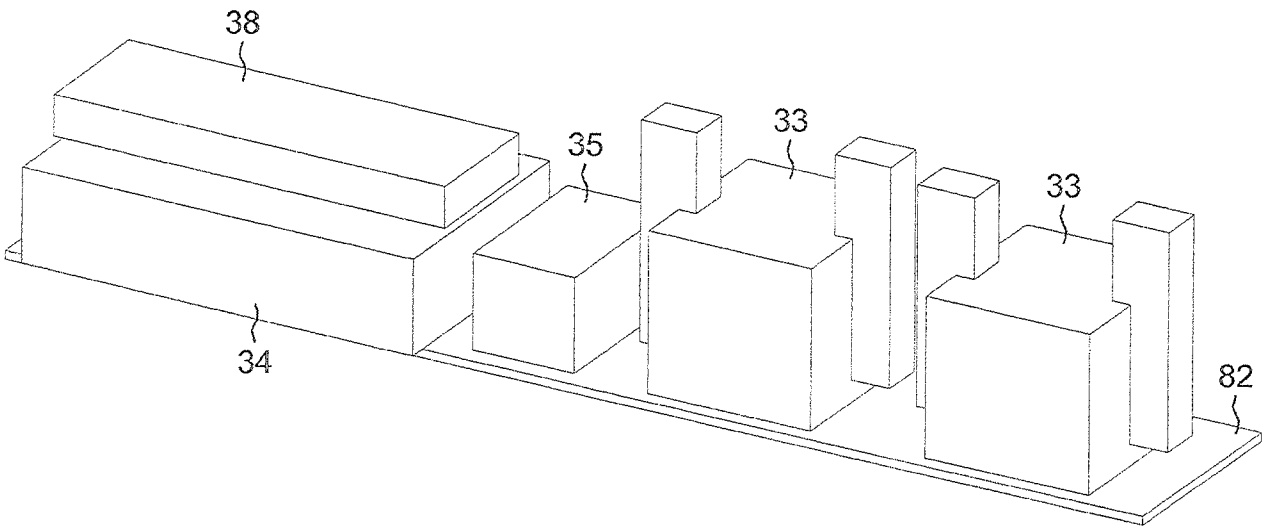
Figure 29:
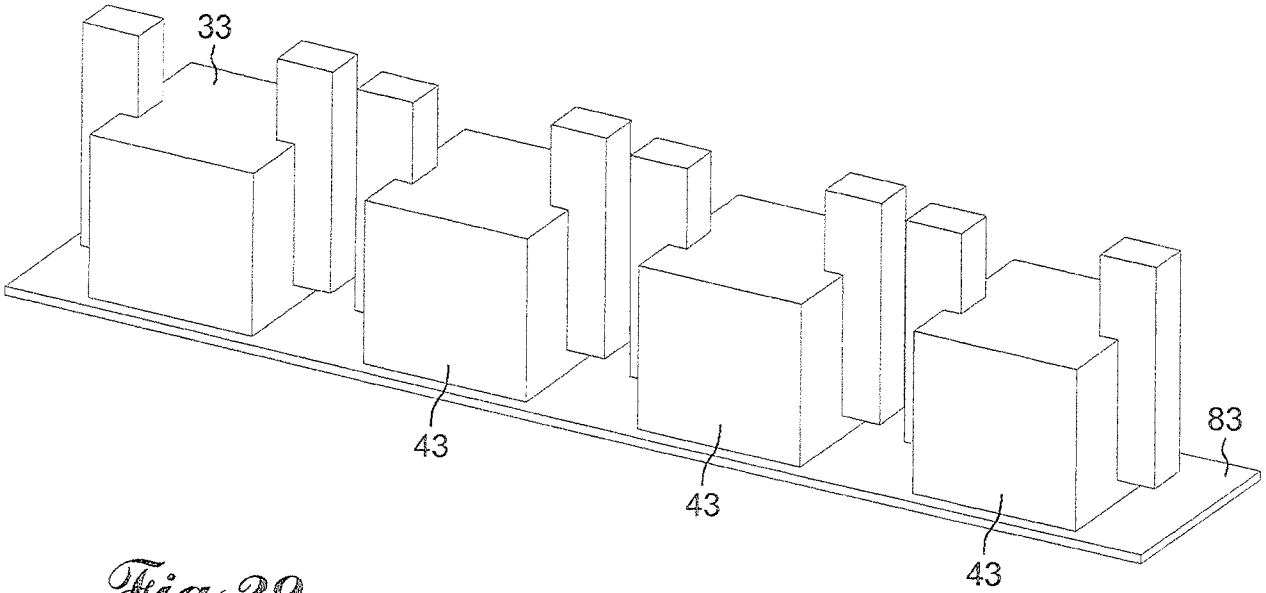

FIGS. 25*a* and 25*b* are front and perspective views of a first state of the system according to the invention;

FIGS. 26*a* and 26*b* are front and perspective views of a second state of the system according to the invention;

FIGS. 27 to 29 are perspective views of the system in a disassembled state for transport.

DETAILED DESCRIPTION

Figure 16:
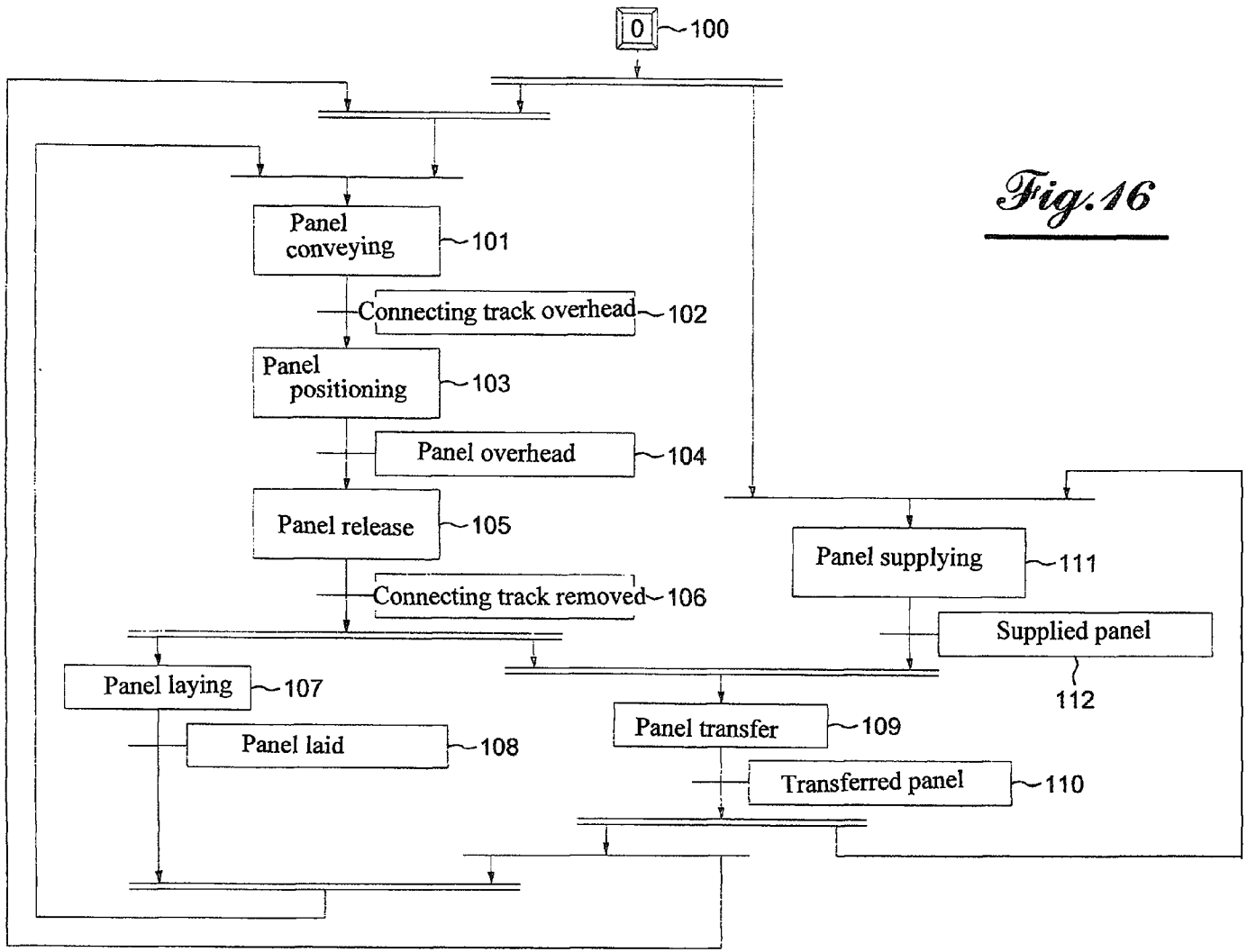
FIG. 16 shows steps of the method conforming to the invention.

To extend railway track downstream of one end of existing track, FIG. 16 shows a method which particularly comprises a step 101 for conveying a current track panel, a step 103 for positioning the current panel downstream of the existing track, in which an operator deploys an off-track travel mechanism so as to position an upstream end of the current panel directly above the end of the existing track, a step 105 for releasing the current panel in which the operator retracts the off-track travel mechanism and a step 107 for laying the current panel in which the operator lowers the current panel until the upstream end of the current panel coincides with the downstream end of the existing track.

In each of preceding FIGS. 1 to 12, substantially in the centre and on the right side, one end 36 of already existing railway track 31 is shown. On the left of the end of the existing track a platform 30 is shown on which the method and system explained below allow the rail track to be extended downstream of the end of the existing track (towards the left in the figure).

Figure 13:
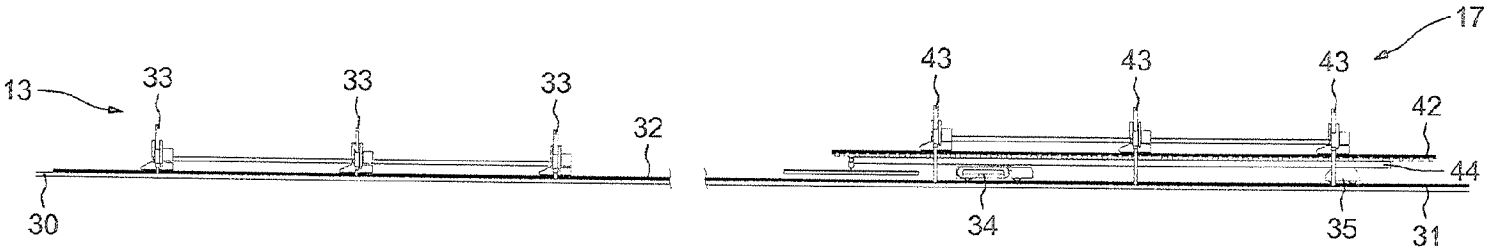
Figure 14:
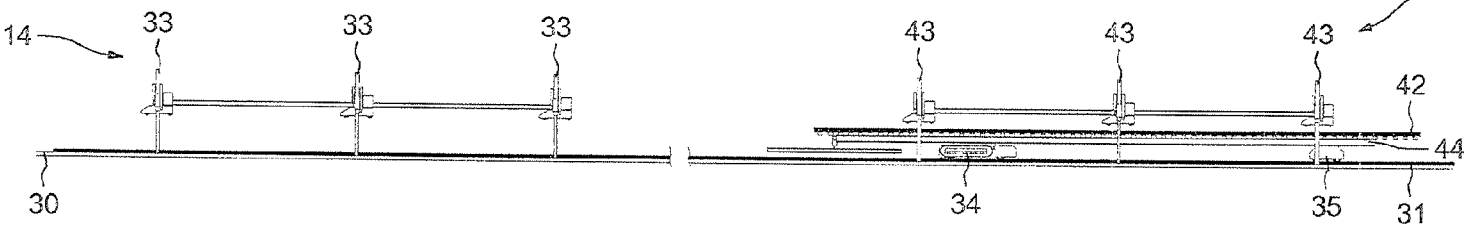
Figure 15:
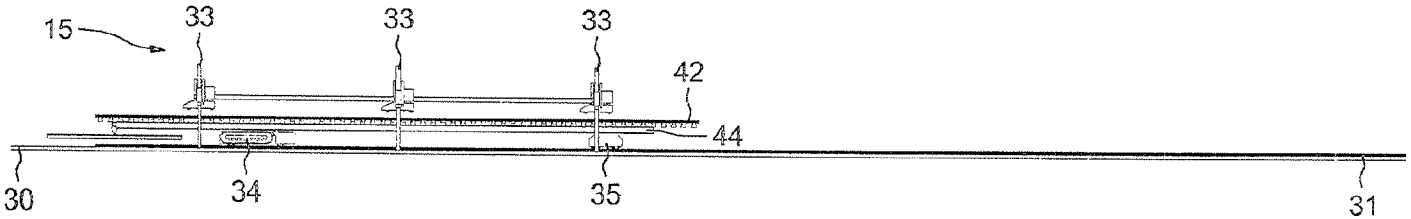
FIG. 15 is a side view of the system ready for repeat of the method according to the invention.

In FIGS. 13 to 15, the end 36 has been offset towards the left so as better to explain some steps which take place on the existing track upstream of the track end 36.

FIG. 16 synthesizes and completes the steps of the method explained with reference to FIGS. 1 to 15.

Figure 1:
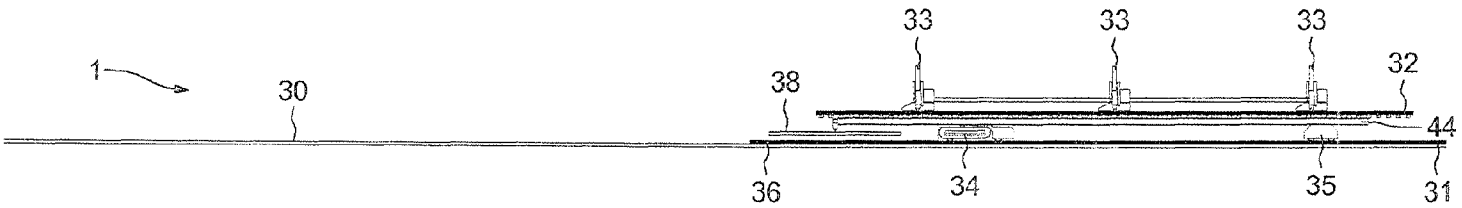
FIGS. 1 and 2 are side views of a system conforming to the invention during two phases of a conveying step.
Figure 2:
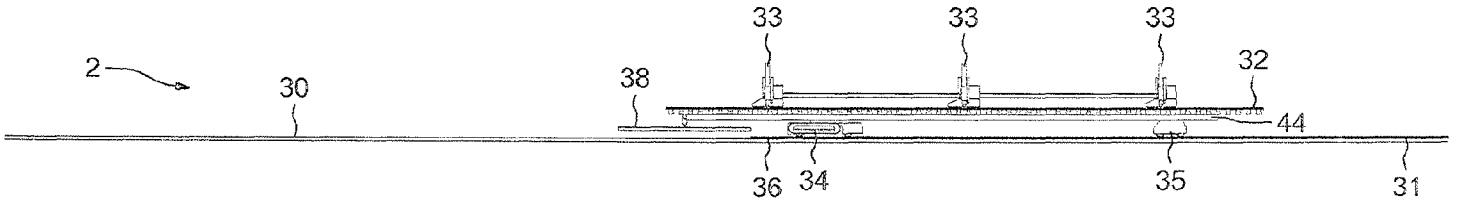

FIGS. 1 and 2 respectively illustrate a first laying phase 1 and a first transient phase 2 within the conveying step 101 of a current track panel 32 in which an operator causes a motorized lorry 34 to travel on the existing track 31, the lorry carrying the current panel 32, so as to bring the motorized lorry 34 near to the end 36 of the track.

Solely as a non-limiting illustration, the operator is a human being, a team of human beings or a programmable logic controller. If the operator is a human being, a portable remote control station allows controlling of the functions which are each servo-controlled for implementing the method. The use of a programmable logic controller is possible provided it is equipped with sensors and a programme that are sufficient to make provision for all the situations which may occur. A human being is able to confront unexpected and varied situations whilst controlling the proper conducting of the method without having to invest in a prohibitive number of sensors and complex combined programming.

Figure 21:
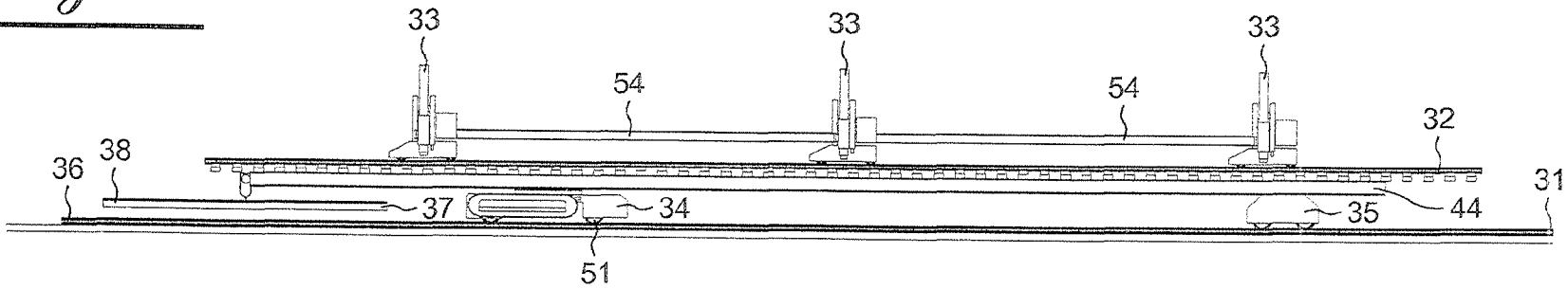
FIG. 21 is a side view of the system illustrated in FIGS. 1 to 15.

FIG. 21 illustrates a system which allows the method of the invention to be carried out so as to extend the rail track downstream of the end 36 of existing track 31. The system particularly comprises a motorized lorry 34, a beam 34 arranged to support the current panel 32 on the motorized lorry 34, at least one extendable gantry crane 33 arranged to hook the current panel 32 thereupon, and connecting track 38 removably bracket-suspended at the front of the motorized lorry 34.

Figure 17:
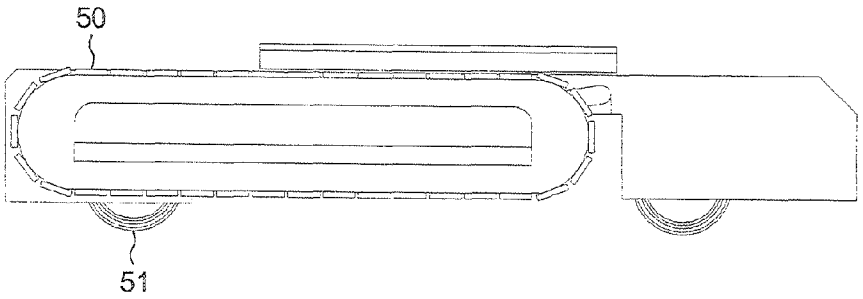
FIGS. 17 to 20 are side and front views of a motorized lorry for implementing the invention.
Figure 18:
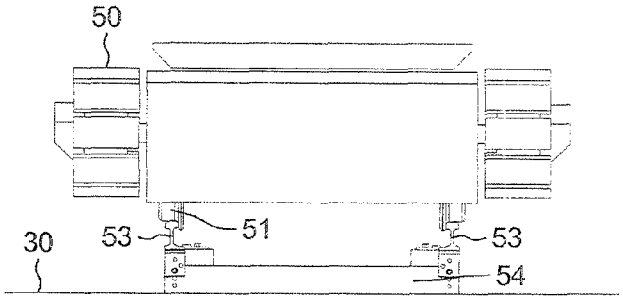
Figure 19:
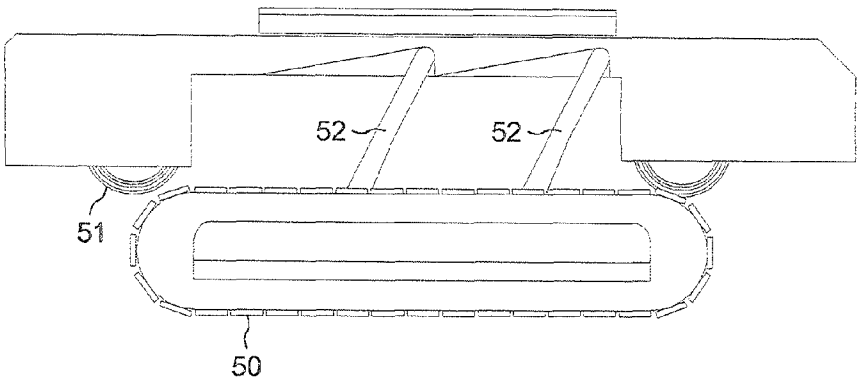
Figure 20:
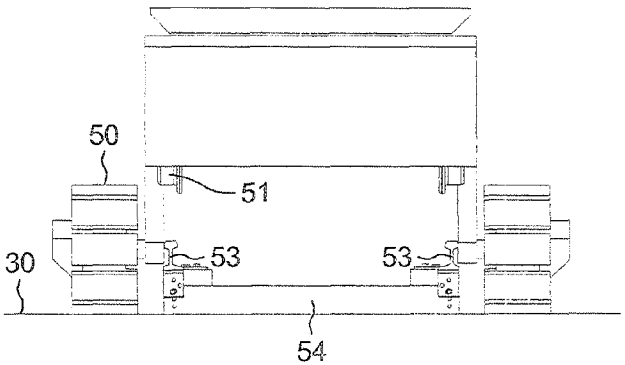

In one preferred embodiment illustrated in FIGS. 17 to 20, the motorized lorry 34 comprises rail wheels 51 for travelling on the existing track 31 and a retractable off-track travel mechanism. The mechanism 50 is a caterpillar mechanism for example which is lowered by arms 52 to below the level of the rail wheels 51. Other off-track travel mechanisms can be envisaged such as a wheel mechanism for example equipped with all-terrain tyres. Therefore, in retracted position as illustrated in FIGS. 17 and 18, the off-track travel mechanism 50 is lifted to place the rail wheels 51 in contact with the rails 53. In deployed position as illustrated in FIGS. 19 and 20, the off-track travel mechanism 50 is lowered to rest upon the platform 30 so as to lift the motorized lorry 34 until its rail wheels 51 are lifted off the rails 53. The motorization of the lorry 34 is of hydraulic, remote controllable type for example.

The purpose of the beam 44 is to maintain the panel 32 flat. In the absence of a beam, the panel which may be 36 meters in length or more for example, even only 24 meters or less, will tend to bend under its own weight to which must be added the weight of the gantries 33 when it is not laid on the ground, on account of the flexibility of the rails having such lengths. The length of the beam is preferably adapted to the length of the panel 32. A slightly shorter length allows the system to be made more lightweight without causing any observable bending at the ends.

The number of extendable gantry cranes 33 is also a function of the length of the panel 32. In the example illustrated in FIG. 21, three extendable gantry cranes 33 are suitable if the length of the panel 32 is 36 meters.

Figure 24:
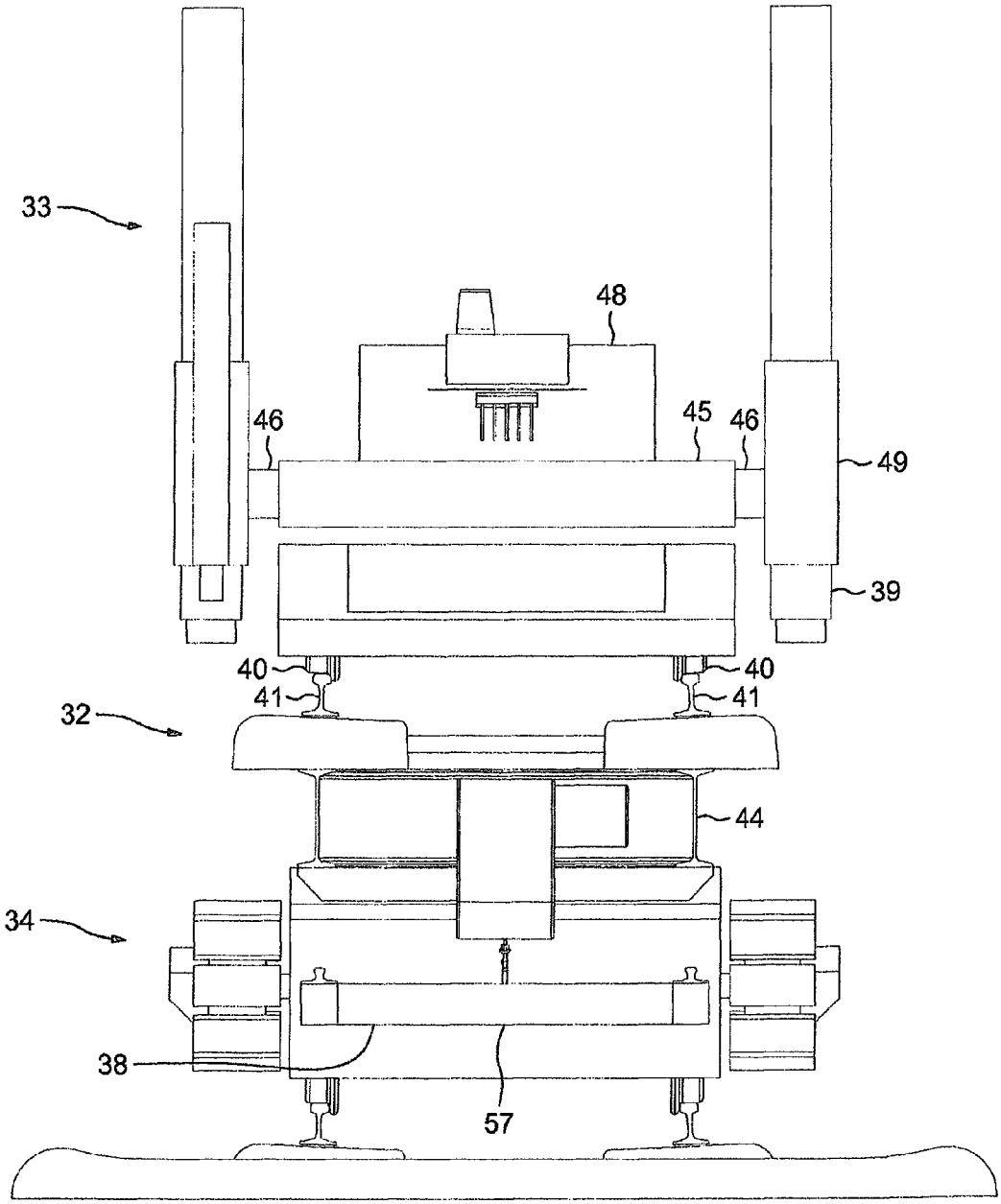
FIG. 24 is a front view of the system in FIG. 21.

FIG. 25*a* and FIG. 25*b* respectively illustrate a front view and perspective view of one possible embodiment of the extendable gantry crane resting on rails 41. The extendable gantry crane 33 illustrated here is equipped with wheels 40 enabling it to travel on the rails 41. The extendable gantry crane 33 comprises a horizontal telescopic lifting beam 45 which comprises an extendable arm 46 either side. A vertical sleeve 49 is fixed to each end of the extendable arm 46. A leg 39 in the form of a vertical column is slidingly mounted in each sleeve 49. In FIG. 24 the arms 46 are illustrated in retracted position. A hydraulic control unit 48 can be remotely driven to extend the two extendable arms 46 so as to deploy the two sleeves 49 on each side of the motorized lorry 34 then to cause each leg 39 to be lowered until the foot bears upon the ground.

Remote controlled clamps 47 allows the current panel 32 to be hooked onto the extendable gantry crane 33 so that when the two legs 39 resting on the ground lift the extendable gantry crane 33, the panel 32 is lifted off the beam 44. The clamps illustrated in open position in FIGS. 25*a* and 25*b* are shown in closed position in FIGS. 26*a* and 26*b*.

If several extendable gantry cranes 33 are used they are connected by link bars 54 so as to form a rigid structure. The hydraulic units 48 are then synchronized so as to generate uniform deployment movement then uniform lifting and lowering of the extendable gantry cranes 33.

As explained above, the beam 44 is essentially useful when the panel 32 is of long length. A very short panel could perfectly well be supported directly on the motorized lorry 34. A panel of average length could be supported by a beam carried by the motorized lorry 34 alone. If the panel 32 is of large size as illustrated in FIG. 21 the system comprises a rail lorry 35 to support the beam 44, which accompanies the movements of the motorized lorry 34 without leaving the track.

As illustrated in FIG. 24, the connecting track 38 comprises two rails of length substantially equal to the length of the motorized lorry 34, held together by cross-ties 57 of length equal to the spacing between the rails. In other words, the cross-ties do not protrude beyond the sides of the rails outside the connecting track 38. With this arrangement it is possible to avoid any contact of the off-track travel mechanism 50 with the cross-tie heads of the last laid panel or of the existing track before extension. In the embodiment illustrated in FIG. 21, the connecting track 38 is hung from the front end of the beam 44. If no beam is used other assemblies could be envisaged, for example a specific arm mounted on the motorized lorry 34.

The mounting of the connecting track 38 onto the end of the beam 44 is detailed in FIG. 22. The front part of the beam 44 comprises an openwork girder 55 supported by a lattice framework 56 to combine lightweight with horizontal rigidity. The lower part of a hook 58 grasps hold of the connecting track 38. An upper end of a bar 61 pivots on a pin 63 secured to the girder 55. The hook 58 pivots on a pin 64 at the lower end of the bar 61.

Figure 23B:
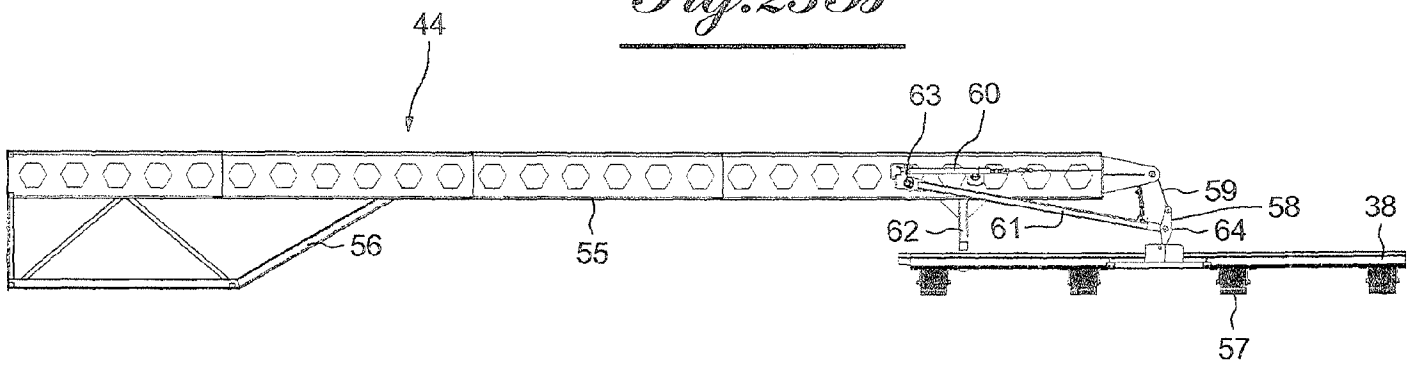
Figure 23A:
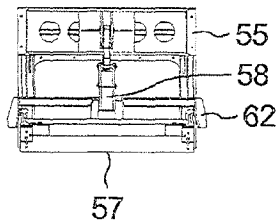

In the raised position of the connecting track 38 illustrated in a side view in FIG. 23*b* and a front view n FIG. 23*a*, a jack 60 fixed to the girder 55 in withdrawn position pulls on a cable 59 whose opposite end is attached to the top of the hook 58. Two cheeks 62 allow the connecting track 38 to be held in raised position in the alignment of the track 31.

Figure 22B:
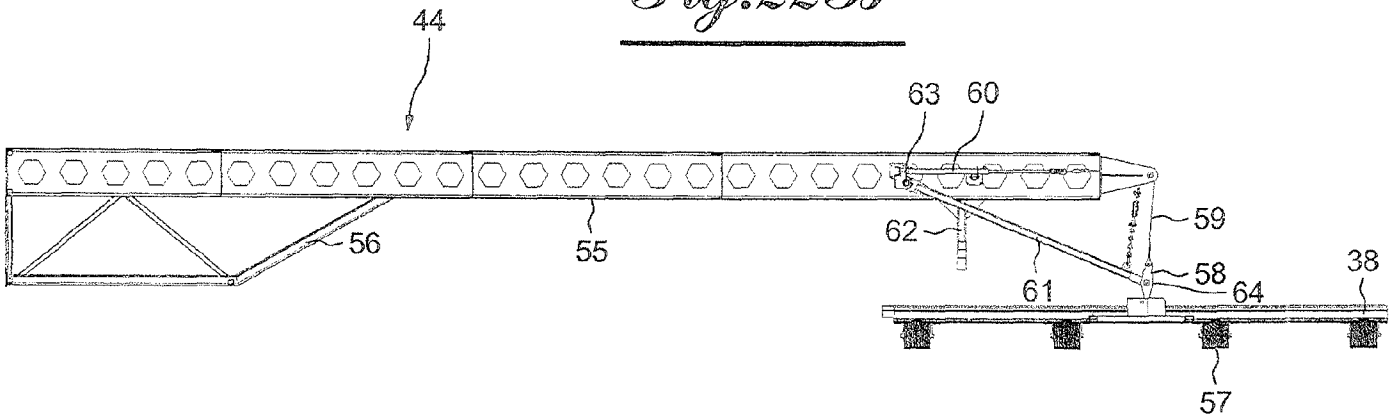
FIGS. 22 and 23 are views of an implementing detail of the invention.
Figure 22A:
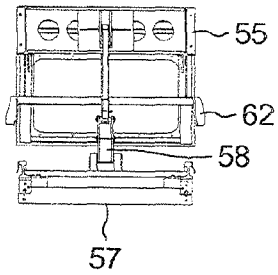

In the lowered position of the connecting track 38, which is illustrated in a side view in FIGS. 22*b* and a front view in FIG. 22*a*, the jack 60 in projecting position releases the traction on the cable 59 so that the connecting track 8 leaves the two cheeks 62 and comes to be aligned with the track 31.

The hook 64 is of known shape to allow firm gripping of the connecting track in raised position and to allow easy release of the connection track in lowered position when the beam 44 moves forward and the connecting track 38 comes to rest on the ground.

At the laying phase 1 illustrated in FIG. 1 and at the transient phase 2 illustrated in FIG. 2, the off-track travel mechanism 50 is in retracted position so as to bring the motorized lorry near to the end of the existing track by causing it to travel on the track 31.

At the laying phase 1 of conveying step 101, the operator hooks at least one extendable gantry crane 33 onto the current panel 32 resting on the beam 44, in particular by remote controlling the clamps 47 so that they close firmly around the rails of the current panel 32. The beam 44 loaded with the panel arrives at the laying front.

During transient phase 2 of step 101, the operator brings the motorized lorry 34 near to the connecting track 38 hanging in raised position in front of the beam 44 until the rear end of the connecting track 38 can be placed directly above the end 36 of the existing track 31. The placing in direct overhead position of the connecting track then validates transition 102 to step 103 during which the current panel 32 is positioned downstream of the existing track 31.

Figure 3:
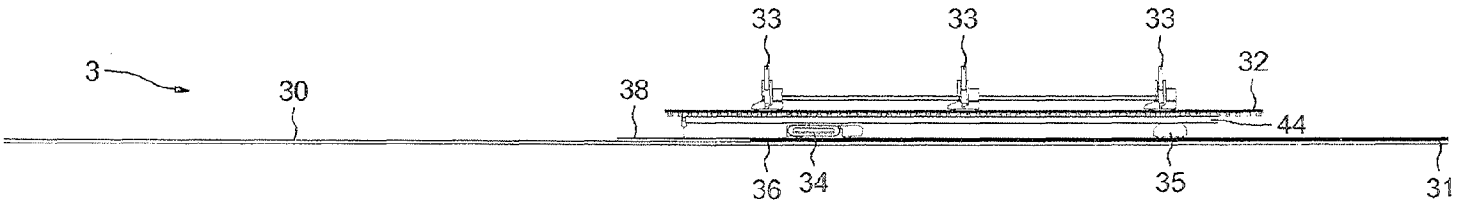
FIGS. 3 to 7 are side views of the system in FIGS. 1 and 2 during five phases of a positioning step.
Figure 4:
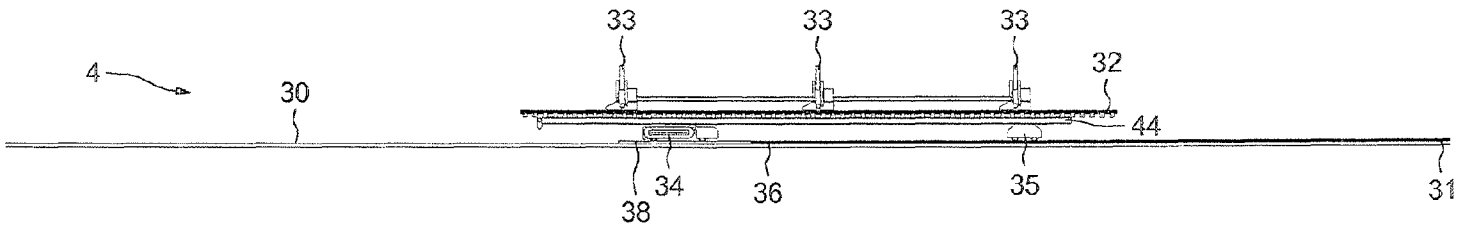
Figure 5:
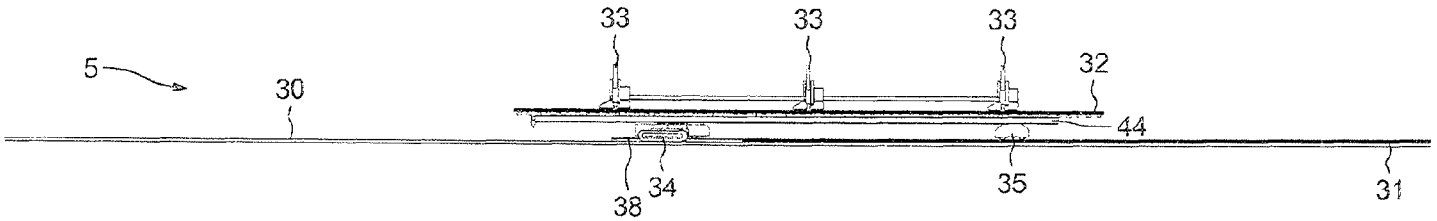

FIGS. 3, 4 and 5 respectively illustrate three transient phases 3, 4 and 5 within step 103. At step 103, the operator deploys the off-track travel mechanism so that it is possible to cause the motorized lorry 34 to travel downstream of the existing track 31 to position the upstream end 37 of the connecting track 38 directly above the end 36 of the existing track 31.

During transient phase 3 of the positioning step 103, the operator lowers the connecting track 38 into the continuation of the existing track 31 in particular by remote controlling the jack 60.

During transient phase 4 of step 103 the operator moves the motorized lorry 34 forwards on the connecting track 38 until it is possible to deploy the off-track travel mechanism off the existing track 31. During transient phase 4 illustrated in FIG. 4, the absence of any cross-ties extending beyond the connecting track allows the deployment of the off-track travel mechanism when the mechanism is entirely on the connecting track. The caterpillars or all-terrain tyres of the mechanism are not hindered by cross-ties in order to touch the ground.

During transient phase 5 of step 103, the operator deploys the off-track travel mechanism by remote controlling rotation of the arms 52 which allows simultaneous contact of the off-track travel mechanism 50 with the ground and the eased contact of the wheels 51 with the rails of the connecting track whilst maintaining the motorized lorry 34 horizontal. The operator uncouples the driving motor of the rail wheels and couples the driving motor of the off-track travel mechanism 50.

Figure 6:
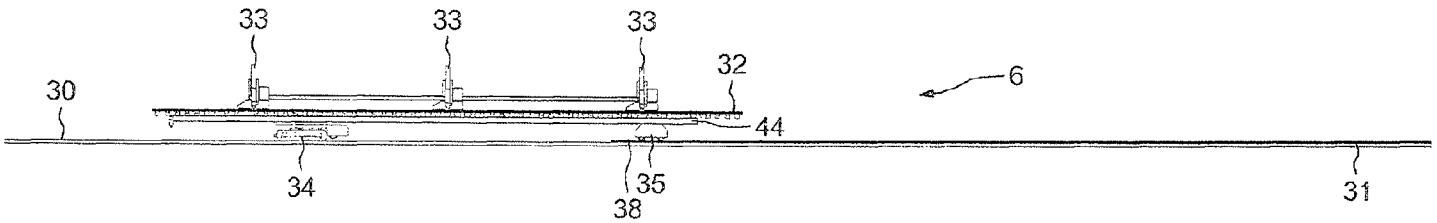
Figure 7:
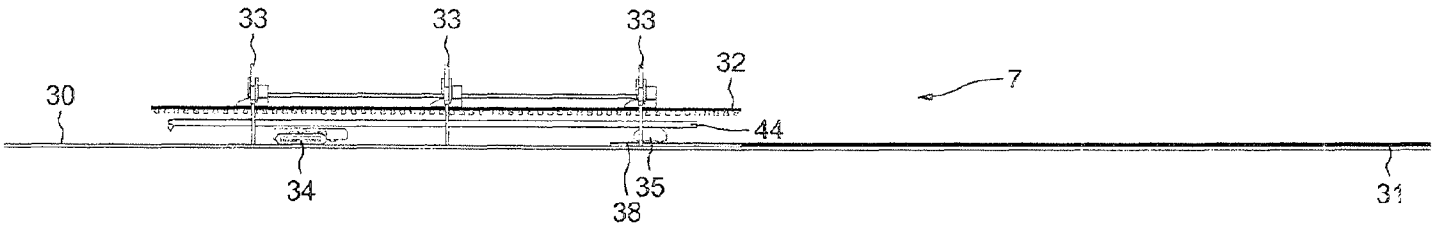
Figure 8:
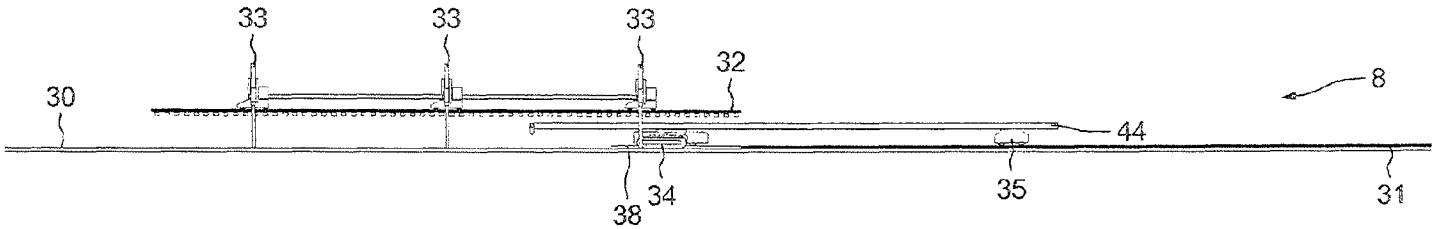
FIGS. 8 to 11 are side views of the system in FIGS. 1 and 2 during four phases of a release step.
Figure 9:
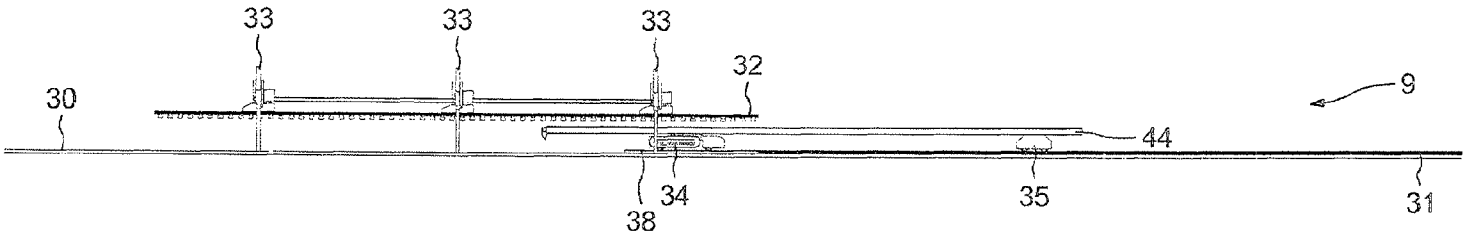
Figure 10:
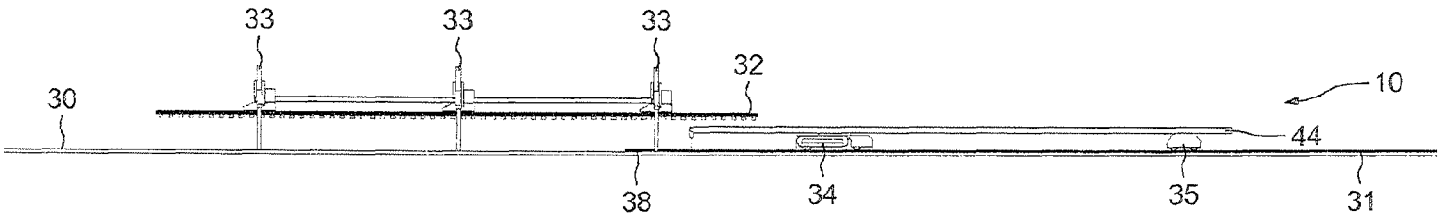
Figure 11:
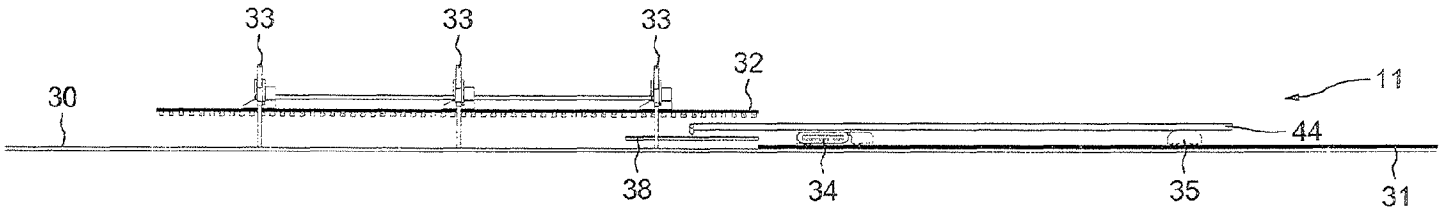

FIGS. 6 and 7 respectively illustrate two laying phases 6 and 7 within positioning step 103.

During laying phase 6, the operator moves the motorized lorry 34 forward by means of the caterpillars which bear on the ground either side of the rails of the connecting track 38. For as long as the rail wheels touch the rails 41 of the connecting track they simply follow by free-wheeling as do those of the rail lorry 35. The operator continues to move the lorry 34 forward which gradually leaves the connecting track without undergoing any misalignment, whether lateral or vertical. The lorry continues to move forward off track until the entirety of the current panel 32 is downstream of the existing track 31 with the rear end of the panel 32 directly above the downstream end of the existing track 31, when the operator immobilizes the motorized lorry 34. The overhang length of the panel 32 at the rear of the beam 44 and the overhang length of the beam 44 at the rear of the rail lorry 35 are such that the rail lorry 35 remains on the connecting track 38 when the rear end of the panel 32 lies directly overhead the downstream end of the existing track 31.

During laying phase 7, the operator synchronously lowers the legs 39 of the extendable gantry cranes 33 until the legs 39 resting on the ground lift up the gantry 33 whose radio-controlled clamps 47 then lift up the current panel 32 from the beam carried by the motorized lorry 34 leaving the upstream or rear end 37 of the current panel 32 directly above the downstream end 36 of the existing track 31. The placing in overhead position of the panel 32 validates transition 104 to step 105 in which the panel is released.

FIGS. 8 to 12 respectively illustrate five transient phases 8 to 12 within the release step 105.

During transient phase 8, the operator uses the off-track travel mechanism to bring the motorized lorry 34 back over the connecting track 38. On reversing, the motorized lorry 34 causes the reversing of the rail lorry 35 on the track 31 by pushing on the beam 44. The rail lorry 35 engaged on the rails, acts naturally on the beam 44 to guide the motorized lorry 34 mechanically towards the connecting track 38.

During transient phase 9 the operator stops the motorized lorry 34 which has arrived on the connecting track 38 then retracts the off-track travel mechanism to replace the rail wheels of the motorized lorry 34 in contact with the connecting track 38. The operator then performs a reverse operation to that of phase 5 to couple the driving motor of the lorry 34 with the rail wheels.

During transient phase 10, the operator sends the motorized lorry 34 back from the connecting track 38 onto the existing track 31 to fully evacuate the beam 44 from underneath the panel 32. By moving back the front end of the beam 44 over the connecting track 38 and with the bar 61 lowered, the hook 64 naturally comes to grasp the connecting track 38. If, during phase 4 or later, the operator had raised the bar 61 to facilitate moving of the beam 44, the operator orders the jack 60 to lower the hook 64 over the connecting track before sending back the lorry 34.

During transient phase 11, the operator lifts up the connecting track 38 for example by commanding withdrawal of the jack 60 which then pulls on the cable 59.

Figure 12:
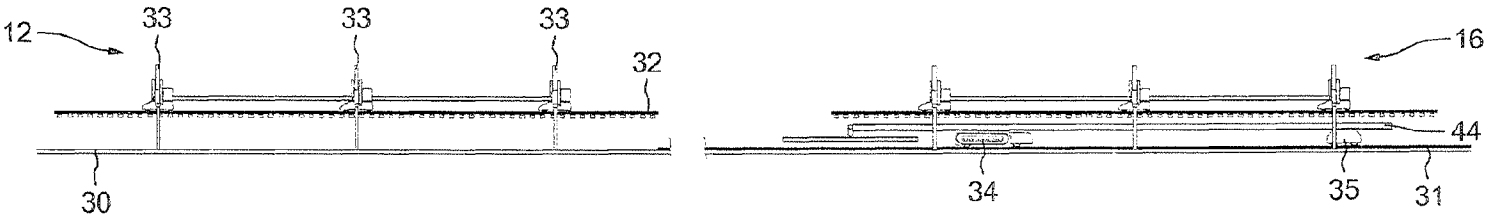
FIGS. 12 to 14 are side views of the system in FIGS. 1 and 2 during three phases of a laying step and during three phases of a transfer step.

During transient phase 12, the connecting track 38 being lifted above the level of the track 31, the operator reverses the motorized lorry 34 which brings the connecting track 38 back above the existing track 31. The track 31 in the centre of FIG. 12 is cut to illustrate the reversing of the lorry 34 to well upstream of the downstream end of the track 31 which corresponds to a phase of another step of the method optionally performed simultaneously with phase 12 which is explained later on the description.

Therefore, the evacuation of the lorry 34 by the operator, at the end of the release step 105 of the current panel 32, leaves the upstream end 37 in other words the rear end of the current panel 32 hanging from the clamps 47 of the extendable gantry cranes 33 directly above the end 36 of the existing track 31. The removed status of the connecting track then validates a transition 106 to the actual laying step 107.

FIGS. 13 and 14 respectively illustrate two laying phases 13 and 14 within the laying step 107 of the current panel 32.

During the laying phase 13 illustrated on the left side in FIG. 13, the operator lowers the extendable gantry cranes 33 so as to lay the current panel 32 in the continuation of the existing track 31. When the panel 32 is laid on the ground, the operator controls opening of the clamps 47 so that the current panel 32 is unhooked from the extendable gantry cranes 33.

At the laying phase 14 illustrated on the left side of FIG. 14, the operator orders the extendable gantry cranes 33 to be raised.

In this manner, the lowering of the current panel 32 on the ground by the operator, at the end of step 105, causes the upstream end 37 of the current panel 32 to coincide with the end 36 of the existing track 31. The current panel 32, laid on the ground, then extends the existing track 31 by a track panel length thereby validating transition 108 towards possible repeat of the method starting from step 101 when needed.

FIGS. 12 to 14 on the right side respectively illustrate three transfer phases 16 to 18 within a transfer step 109 during which the operator loads a following panel 42 on the motorized lorry 34, more particularly on the beam 44 carried by the motorized lorry, subsequent to validation of the transition 106.

During the first transfer phase 16, the operator brings the beam 44 carried by the motorized lorry 34 to underneath a set of second extendable gantry cranes 43 from which the following panel 42 is hung.

At the second transfer phase 17, the operator lowers the extendable gantry cranes 43 so as to lay the following panel 42 on the beam 44.

At the third transfer phase 18, the operator lifts up the second extendable gantry cranes 43 to leave the following panel 42 on the beam 44.

Transfer step 109 is completed by a fourth transfer phase 15 illustrated in FIG. 15. At transfer phase 15, the operator moves the motorized lorry 34 forward so as to place the beam 44 supporting the following panel underneath the first set of extendable gantry cranes 33. Transition 110 is validated at the end of step 109 when the panel 42 is transferred to under the extendable gantry cranes 33. The validation of transition 110 allows re-looping of the implementation of the method onto conveying step 101 during which the following panel 42 then becomes the current panel 32.

The performing of one or more transfer phases during laying step 107 provides savings in time for extending the track 31.

For as long as track panels are to be laid one after the other to extend the existing track, each validation of the transition 110 activates a feed step 111 for a supply panel of the method.

When the following panel 42 is transferred towards the extendable gantry cranes 33, the extendable gantry cranes 43 are free for hooking a supply panel thereupon which then becomes the new following panel 42. The supply can be ensured for example by bringing a transport wagon—not illustrated—to underneath the extendable gantry cranes 43, on which one or more track panels are stacked to supply the system.

The supplied panel validates transition 112 to step 109 ready to be activated subsequent to the next validation of transition 106.

The method of the invention has been described with respect to extending track beyond existing track. Evidently the method can also be applied for track renewal, the former track being removed to leave the way free for laying new track which then forms a track which is extended as and when the former track is removed.

In one preferred embodiment a length of beam 44 e.g., between 31 meters and 32 meters as a non-limiting illustration, provides support for track panels 36 meters in length. Advantageously, the beam 44 can be separated into three parts 44*a*, 44*b* and 44*c* which can be loaded onto a platform 81 of a road vehicle as illustrated by the packing in FIG. 27. Four link bars 54 can be housed in a hollow part of the beam part 44*c* and four link bars 75 used for rigid maintaining of the extendable gantry cranes 43 can be housed in a hollow part of beam part 44*b*. The dimensions of the system elements just described are sufficiently small to leave room on platform 81 of standard size for the stowing of six low bearing pads 73 and six high bearing pads 74. The six low bearing pads 73 are each designed to be assembled at the base of one of the two legs 39 of an extendable gantry crane 33 so as to facilitate the bearing of the three extendable gantry cranes 33 used for laying. The six high bearing pads 74 are provided for each to be assembled at the base of one of the two legs 39 of the extendable gantry crane 43 so as to facilitate the bearing of the three extendable gantry cranes 43 used for transfer. The bearing pads 74 are raised so as to allow the passing underneath the three extendable gantry cranes 43 of a stack of track panels loaded on a transport wagon.

With reference to the packing in FIG. 28, a second platform 82 of a road vehicle is suitable for transporting the motorized lorry 34, the connecting track panel 38, also called provisional track panel, the rail lorry 35 and two extendable gantry cranes in stowed position.

With reference to the packing in FIG. 29 a third platform 83 of a road vehicle is suitable for transporting four extendable gantry cranes in stowed position.

For the sizing of the system of the invention, every possible weight reduction is sought to promote saving in energy whilst preserving the mechanical robustness required for implementing the method of the invention.

Three trucks therefore allow the transporting of the system of the invention via road to the construction sites thereby providing large flexibility of use. At initial step 100 of the method, the system is brought on site, preferably when the wagons transporting the track panels are already on site to minimize the stay time of the system on the site. At step 100, the elements of the system are unloaded from the platforms 81, 82 and 83 then the system is assembled. At the end of step 100, the system is then ready to initiate steps 101 and 111 of the method of the invention.

It is noted that the method and system just described are modular and can be adapted to different track panel lengths. The description has been given with respect to panels 36 meters in length which require three extendable gantry cranes. For operation with panels 24 meters in length, it is possible to envisage only sets of two extendable gantry cranes and to reduce the length of the beam by placing end to end the front part 44*a* and the rear part 44*c* without assembling the central part 44*b* of the beam 44.

The method of invention allows rail track of excellent quality to be obtained rapidly and at low cost.

The invention claimed is:

1. A method for extending rail track downstream of an end of existing track, the method comprising:

conveying a current track panel, with a motorized lorry having rail wheels and a retracted off-track travel mechanism, on the existing track, by moving the motorized lorry near the end of the existing track, with the motorized lorry carrying connecting track, bracket-suspended at a front end of the motorized lorry, until a rear end of the connecting track lies directly above the end of the existing track;

positioning the current track panel downstream of the existing track by deploying the off-track travel mechanism and positioning an upstream end of the current track panel directly above the end of the existing track by moving the motorized lorry downstream of the existing track by lowering the connecting track panel into continuation with the existing track, moving the motorized lorry forward on the connection track to a position where deployment of the off-track travel mechanism off the existing track is possible, and deploying the off-track travel mechanism;

releasing the current track panel and removing the motorized lorry, leaving the upstream end of the current track panel directly above the end of the existing track by using the off-track travel mechanism to return the motorized lorry over the connecting track, retracting the off-track travel mechanism and putting the rail wheels of the motorized lorry into contact with the connecting track, moving the motorized lorry from the connecting track onto the existing track and taking hold of the connecting track, lifting the connecting track, and reversing the motorized lorry and bringing the connecting track above the existing track; and laying the current track panel by lowering the current track panel until the upstream end of the current track panel coincides with the end of the existing track.

2. The method according to claim 1, wherein the upstream end of the current track panel is left directly above the end of the existing track, the conveying comprises hooking an extendable gantry crane onto a first current pane, the positioning comprises immobilizing the motorized lorry when all of the current panel is downstream of the existing track, and lowering and resting on the ground at least one leg of the extendable gantry crane, and lifting a gantry of the extendable gantry crane, which lifts the current track panel above the motorized lorry.

3. The method according to claim 2 including:

lowering the extendable gantry crane, laying the current track panel in a continuation of the existing track, unhooking the extendable gantry crane from the current track panel, and lifting the extendable gantry crane.

4. The method according to claim 1, comprising loading a following track panel on the motorized lorry and repeating the conveying, whereby the following track panel becomes the current track panel.

5. The method according to claim 4, wherein the transferring comprises:

bringing a beam carried by the motorized lorry underneath an extendable gantry crane from which the following track panel is hung; and lowering the extendable gantry crane and laying the following track panel on the beam.

6. The method according to claim 5, wherein the transferring comprises lifting the extendable gantry crane, leaving the following track panel on the beam, and moving the motorized lorry forward, placing the beam underneath the extendable gantry crane.

7. The method according to claim 6, wherein at least part of the transferring is carried out during the laying.

8. An apparatus for extending rail track downstream of an end of existing track, the apparatus comprising:

a motorized lorry which comprises rail wheels for travelling on the existing track, and a retractable off-track travel mechanism so that the motorized lorry can transport a current track panel on the existing track and off the existing track;

at least one first extendable gantry crane for hooking the current panel; and connecting track removably bracket-suspended at a front end of the motorized lorry.

9. The apparatus according to claim 8 including a beam supporting the current track panel on the motorized lorry.

10. The apparatus according to claim 9 comprising a rail lorry supporting the beam by moving with the motorized lorry, without leaving the track.

11. The apparatus according to claim 8 comprising a second extendable gantry crane for hooking a following track panel.

12. The apparatus according to claim 8, wherein the connecting track comprises two rails having lengths substantially equal to length of the motorized lorry and held together by cross-ties having lengths equal to spacing of the rails.

* * * * *